US005673072A

United States Patent [19]

Scheffelin

[11] Patent Number: 5,673,072

[45] Date of Patent: Sep. 30, 1997

[54] METHOD AND APPARATUS FOR REFILLING A PRINT CARTRIDGE HAVING A SPHERICAL STOPPER

[75] Inventor: Joseph E. Scheffelin, San Diego, Calif.

[73] Assignee: Hewlett-Packard Company, Palo Alto, Calif.

[21] Appl. No.: 332,009

[22] Filed: Oct. 31, 1994

[51] Int. Cl.[6] ..... B41J 2/17

[52] U.S. Cl. ..... 347/85

[58] Field of Search ..... 347/85, 86, 87; 141/21, 23–25, 27, 113, 1, 2

[56] References Cited

U.S. PATENT DOCUMENTS

| | | | |
|---|---|---|---|
| 4,548,020 | 10/1985 | Rozmus et al. | 53/268 |
| 4,597,245 | 7/1986 | Parker | 53/510 |
| 4,750,532 | 6/1988 | Grothoff | 741/27 |
| 4,967,207 | 10/1990 | Ruder | 347/87 |
| 4,968,998 | 11/1990 | Allen | 347/87 |
| 5,400,573 | 3/1995 | Crystal et al. | 347/87 |
| 5,488,400 | 1/1996 | Crystal et al. | 347/85 |

FOREIGN PATENT DOCUMENTS

| | | | |
|---|---|---|---|
| 106729 | 4/1994 | Japan | 347/86 |
| WO94/11194 | 5/1994 | WIPO | B41J 2/175 |

*Primary Examiner*—N. Le
*Attorney, Agent, or Firm*—Edward Maker, II

[57] ABSTRACT

A cylinder and piston containing refill ink for refilling print cartridges having a spherical stopper. A stopper remover engages the spherical stopper and dislocates it with respect to the print cartridge. Refill ink is thereafter transferred from the cylinder into the reservoir of the print cartridge. The spherical stopper is withdrawn and a replacement spherical stopper seated.

16 Claims, 11 Drawing Sheets

METHOD AND APPARATUS FOR REFILLING A PRINT CARTRIDGE HAVING A SPHERICAL STOPPER

1. Field of the Invention

The present invention generally relates to print cartridges that are received in computer controlled printers and, more particularly, to methods and apparatus for refilling such print cartridges.

2. Background of the Invention

Printers are devices that print characters onto a printing medium such as paper or polyester film and are commonly controlled by a computer that supplies the image in the form of print commands. Some printers use a colorant-containing liquid which may be either a dye or a polymer. These liquids are termed "ink" in the printer industry. The printer forms images on the printing medium by delivering ink to the medium using a print head that creates the proper patterns of ink to record the image permanently.

One type of printer is the ink-jet printer which forms a small droplets of ink that are ejected toward the printing medium in a precise pattern of dots. When viewed at a distance, the collection of dots forms the image in much the same manner as photographic images are formed in newspapers. Ink-jet printers are fast, produce high quality printing, and are quiet because there is no mechanical impact during operation.

Typically, an ink-jet printer has a large number of individual ink nozzles that are arranged in arrays in the print head. The print head is supported in a carriage, and the ink nozzles are oriented in a facing, but spaced apart, relationship to the printing medium. The carriage and the printhead traverse over the surface of the medium again and again with the nozzles ejecting droplets of ink at appropriate times under the command of the computer. After each transverse by the print head, the printing medium is moved an increment in the direction lateral to the transverse and thereafter the carriage with the print head traverses the page again to deposit another swath. In this manner the entire pattern of dots that forms the image is progressively deposited one swath at a time by the print head.

In a thermal ink-jet printer the ejection of droplets is accomplished by heating a small volume of ink adjacent the nozzle, vaporizing a bubble of ink, and thereby driving a droplet of ink through the nozzle toward the printing medium. The droplets strike the medium and then dry to form "dots" that, when viewed together, form one swath of the permanently printed image.

In some types of printers the ink is stored in a reservoir that is mounted on the carriage along with the print head. Ink is then delivered by capillary action to the nozzles. In these printers the print head is a single-use, consumable, disposable unit that may be readily inserted and removed from the printer when the ink reservoir is exhausted. One such printer and the print cartridges for it are described in *Hewlett-Packard Journal*, February 1994, Volume 45, Number 1.

In the early stages of the development of thermal ink-jet printers, the useful life of a print head was usually determined by the length of time until the first nozzle failed. More recently the design of nozzles and print heads has so advanced that the life of the nozzles prior to failure has significantly lengthened. In other words, the supply of ink in a reservoir may now be exhausted before a nozzle failure is experienced. Thus, there now exists a need for a larger supply of ink to be available for print cartridges because of the extended nozzle life.

Simply increasing the size of the ink reservoir has not proved to be an acceptable solution however. Typically, a reservoir is supported on the printer carriage and moves with the print head. Increasing the size of the reservoir would necessarily increase the size and weight of the structure that supports and moves the carriage back and forth. This would cause the performance of the printer to suffer because of the increased mass of the carriage and would also significantly increase the cost of the printer.

Still another solution would seem to be to refill the empty print cartridges with replenishment ink. This would allow the print heads to be used again and again until nozzle failure. As of yet this approach has not proven to be reliable or satisfactory because of at least four significant problems.

The first problem and probably the most significant from the operator's point of view is how to transfer ink from a replenishment ink reservoir to the print cartridge while avoiding spillage and leakage. No operator wants to have his or her hands, clothing, or work areas stained by spilled ink.

The second problem is maintaining the operating pressure in the print cartridge during the next operating cycle. Normally, print cartridges operate at a pressure range of approximately two to four inches of an inch of water below atmospheric pressure, and the ink is supplied to the nozzles at this pressure by capillary action. In some print cartridges the pressure of the ink in the reservoir is maintained by a collapsible ink bag and a spring which urges the walls of the ink bag apart against atmospheric pressure. If the pressure of the ink exceeds a maximum level, ink will be forced out of the nozzles and the print cartridge will "drool" ink onto the paper and into the printer. If the pressure of the ink in the print cartridge drops below a minimum level, the flow of ink to the nozzles will stop because the capillary pressure is exceeded.

A third problem is maintaining the pressure of the ink in the print cartridge during refilling. If the pressure of the ink exceeds a maximum level during refilling, then ink will drool from the nozzles and leakage will occur. If the pressure in the print cartridge drops below a minimum level, then air may be drawn into the nozzles which may block the passage of ink and cause nozzle failure.

A fourth problem is the inadvertent introduction of air or gasses into the print cartridge during replenishment. If bubbles are entrapped in the print cartridge during replenishment, these bubbles can travel within the print cartridge and block the narrow passage ways leading to the print nozzles and thereby cause nozzle failure.

It will be apparent from the foregoing that although there are many processes and apparatus for refilling print cartridges, there is still a need for an approach that avoids spillage and leakage and properly maintains the pressure within the print cartridge during refilling and the next operating cycle.

SUMMARY OF THE INVENTION

Briefly and in general terms, an apparatus according to the invention includes a cylinder for holding ink for refilling, a piston received within the cylinder for transferring ink to a print cartridge and a stopper remover for engaging the spherical stopper in the print cartridge and for opening the print cartridge to receive refilling ink. The apparatus forms a fluid-tight seal between the cylinder and the print cartridge. The apparatus further includes a replacement spherical stopper that is sealable in the print cartridge after refilling.

In operation, the apparatus first establishes fluid communication between the print cartridge and the reservoir of refilling ink. The apparatus empties residual ink from the print cartridge and thereafter transfers refilling ink into the print cartridge. The process further includes the steps of dislocating the original spherical stopper with respect to the print cartridge and seating a new spherical stopper after the step of transferring ink into the print cartridge.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
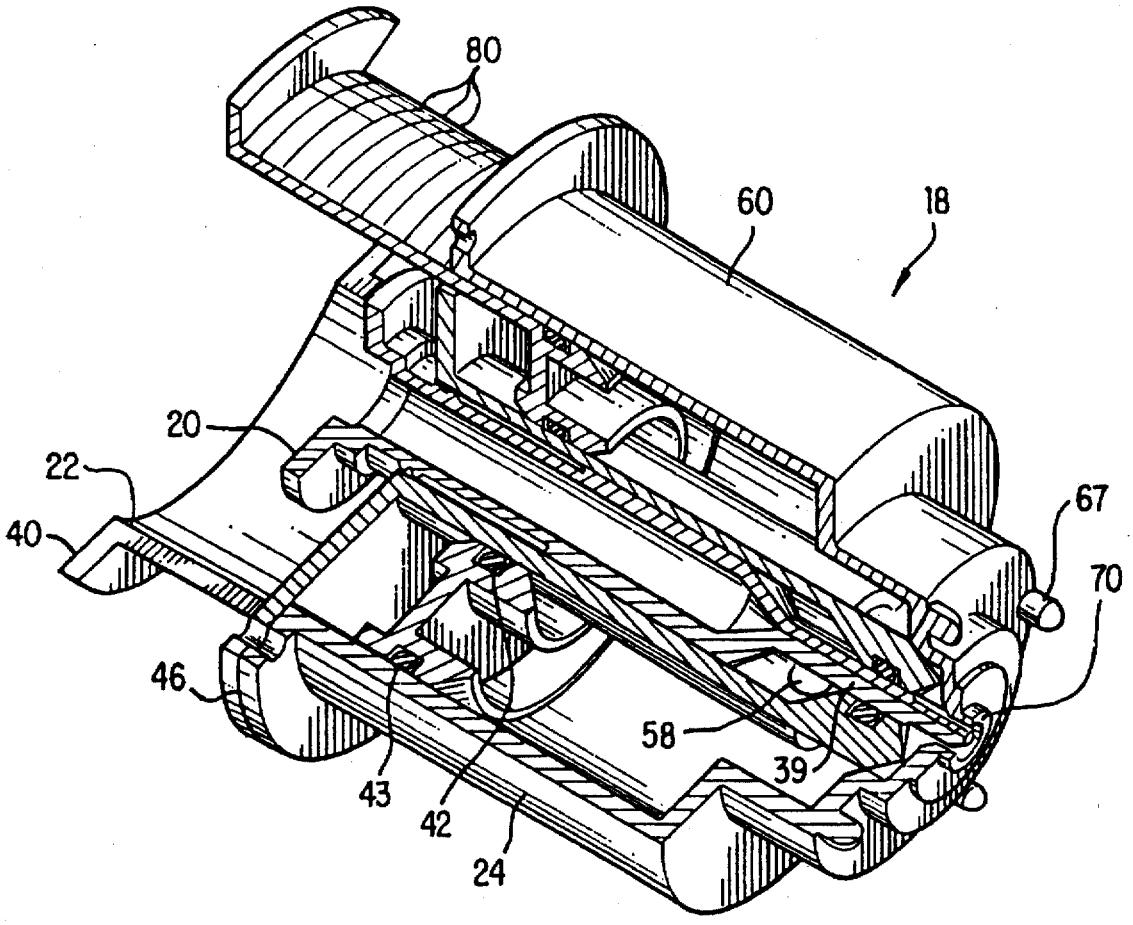
FIG. 1 is a perspective view, in section and partially cut away, of an apparatus for refilling print cartridges having a spherical stopper embodying the principles of the invention.

As shown in the drawings for the purposes of illustration, the invention is embodied in a single-use, ink reservoir in the shape of a cylinder. A piston transfers ink from the cylinder. Central to the apparatus is a stopper remover for dislocating the spherical stopper in the print cartridge and for seating a replacement stopper.

The apparatus offers a simple solution, easy operation, and disposability. The apparatus has the capability of removing any undissolved gasses which may be trapped in the print cartridge before and during refilling.

Referring to FIGS. 1–5, reference numeral 18 generally indicates a refilling apparatus of the preferred embodiment. The refilling apparatus includes a stopper remover 20 for engaging a spherical stopper 28 in a print cartridge 26 and for opening the print cartridge to receive the refilling ink. The apparatus further includes a piston 22 for transferring ink to the print cartridge and a cylinder 24 for receiving the piston and for holding the ink in the apparatus.

Figure 2:
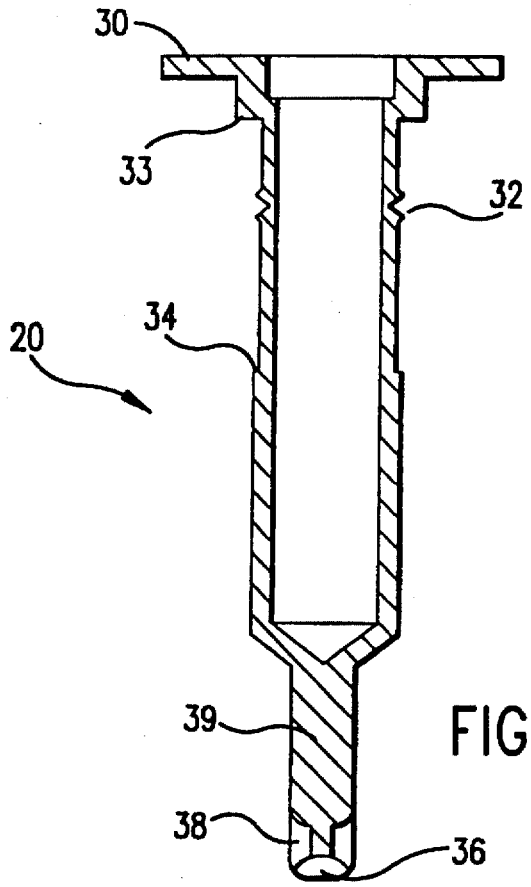
FIG. 2 is a side elevational view, in section, of the stopper remover of FIG. 1.
Figure 6:
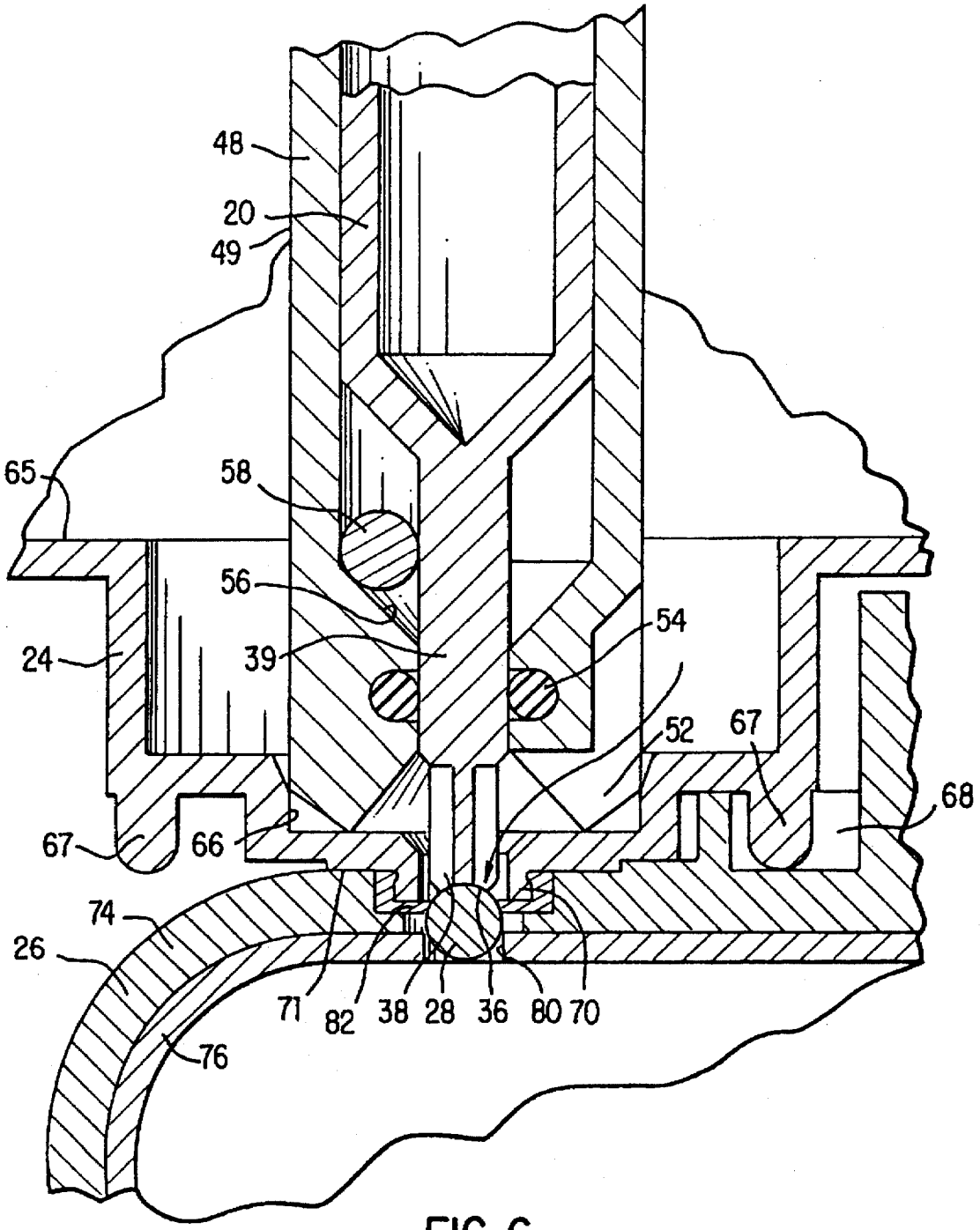
FIG. 6 is an exploded, side elevational view, in section and in rotated section and partially cut away, of the portions of the apparatus indicated in FIGS. 2, 4 and 5.

Referring now particularly to FIGS. 2 and 6, the stopper remover 20 has a generally elongate, hollow shape with a flange 30 at its upper end. The flange permits the operator to raise and lower the stopper remover manually. Located in the upper, medial portion of the stopper remover are two detents 32 which mark the middle position of travel of the stopper remover. These detents engage a portion of the cylinder 24 and, tactidely mark the lower position beyond which the spherical stopper 28 is engaged. The stopper remover further includes two sets of hard stops 33 and 34 which limit the upward and downward travel of the stopper remover. The hard stops engage a portion of the cylinder 24 as is described below. The stopper remover 20 also includes a stem 39 and a concave tip 36 for engaging the spherical stopper 28. Further, the stopper remover includes four webs 38 located on a distal end of the stem to provide flow passages for the ink during refilling.

Figure 3:
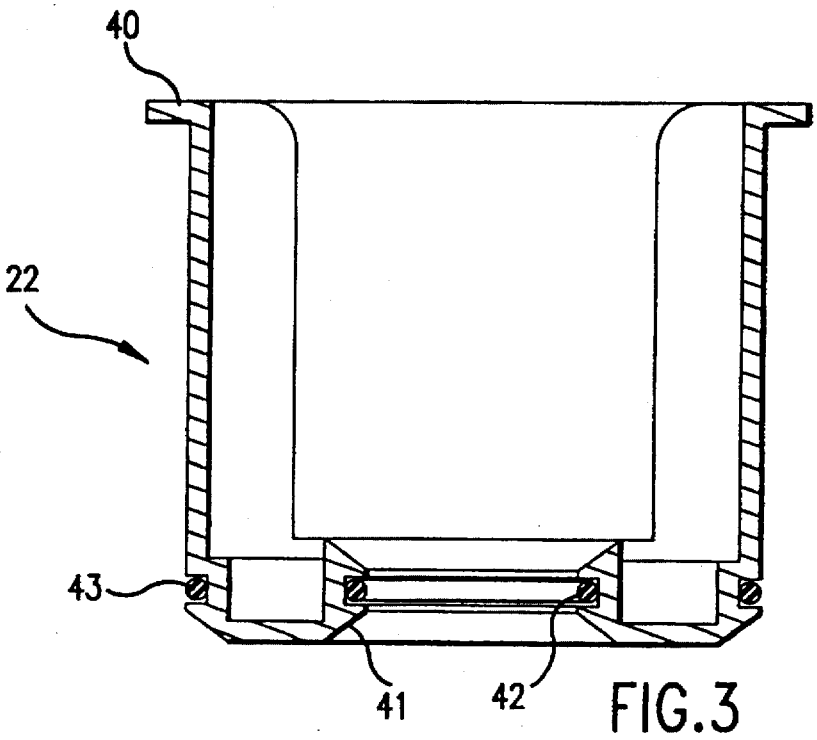
FIG. 3 is a side elevational view, in section, of the piston of FIG. 1.

Referring to FIG. 3 the piston 22 includes a flange 40 located at its upper distal end. The flange serves as a handle permitting the piston to be moved up and down relative to the cylinder 24, FIG. 4. The piston further includes a central port 41 located at the lower distal end of the piston. The central port includes an O-ring channel and an inner O-ring 42. Opposite the inner O-ring channel is an outer O-ring channel containing an outer O-ring 43. The inner and outer O-rings 42, 43 engage the inner and outer sidewalls of the cylinder 24, FIG. 4 and provide a fluid-tight seal.

Figure 4:
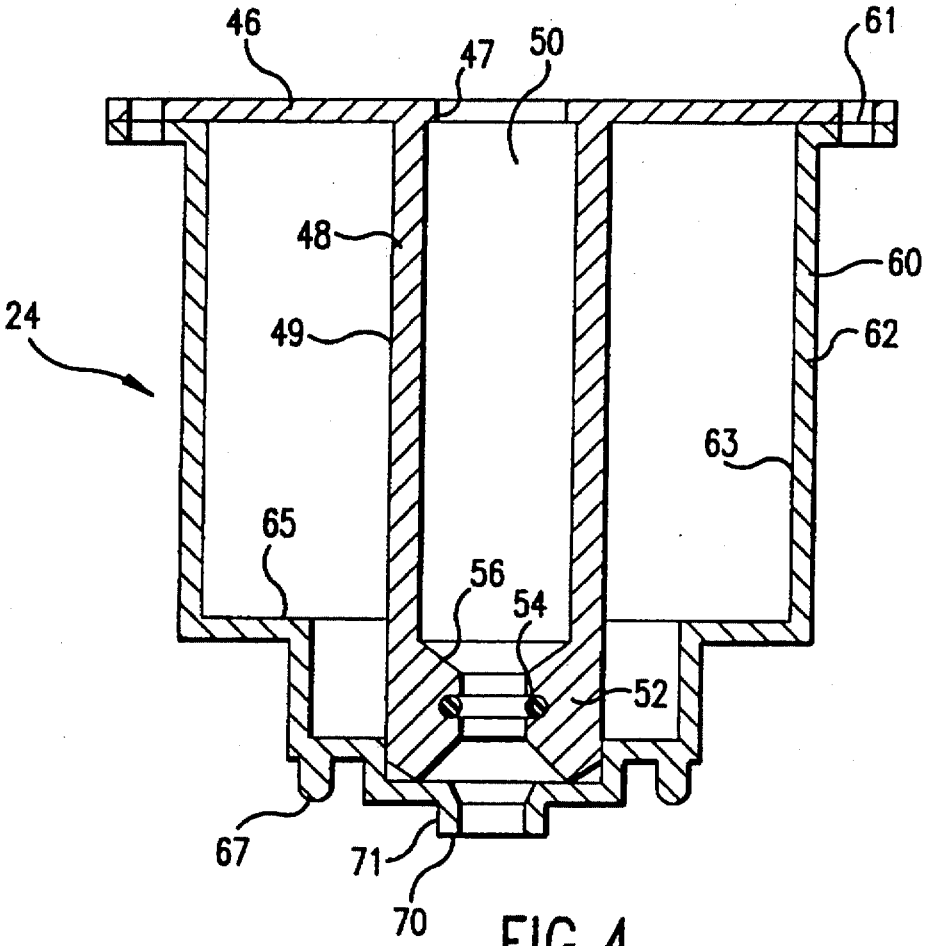
FIG. 4 is a side elevational view, in section, of the cylinder of FIG. 1.

Referring to FIGS. 4 and 6, the cylinder 24 includes a top portion 46 that has a generally hollow, T-shaped cross section. The top portion includes a port 47 and a bore 50 that receive the stopper remover 20, FIG. 2. The hard stops 33, 34, FIG. 2 engage the rim of the port 47 as do the detents 32, FIG. 2. The port 47 limits the upward and downward extreme travel of the stopper remover 20 as well as tactidely indicates where the concave tip 36 commences to engage the spherical stopper 28, FIG. 6. The top portion 46 of the cylinder 24 further includes an inner cylinder 48 which receives the stopper remover 20. The inner cylinder has an exterior vertical sidewall 49 which is engaged by the inner O-ring 42 of the piston 22, FIG. 3. The top portion has a plurality of webs 52, FIG. 6 at its lower distal end which provide flow channels for the refilling ink through the sidewall 49 of the inner cylinder 48. In FIG. 6 the webs are shown in rotated section to illustrate their construction. The webs also engage the walls of a well 66, FIG. 6 to provide alignment for the inner cylinder 48. At the lower distal end of the inner cylinder 48 contained within its bore is an O-ring groove and an O-ring 54. The O-ring 54 engages and forms a seal with the stem 39 of the stopper remover 20. The inner cylinder 48 further includes an inclined surface 56 within its bore that retains a replacement sphere 58. When the stem 39 is removed in an upward direction, the replacement sphere 58 rolls down into position for being seated in the print cartridge 26 as described below.

Figure 10:
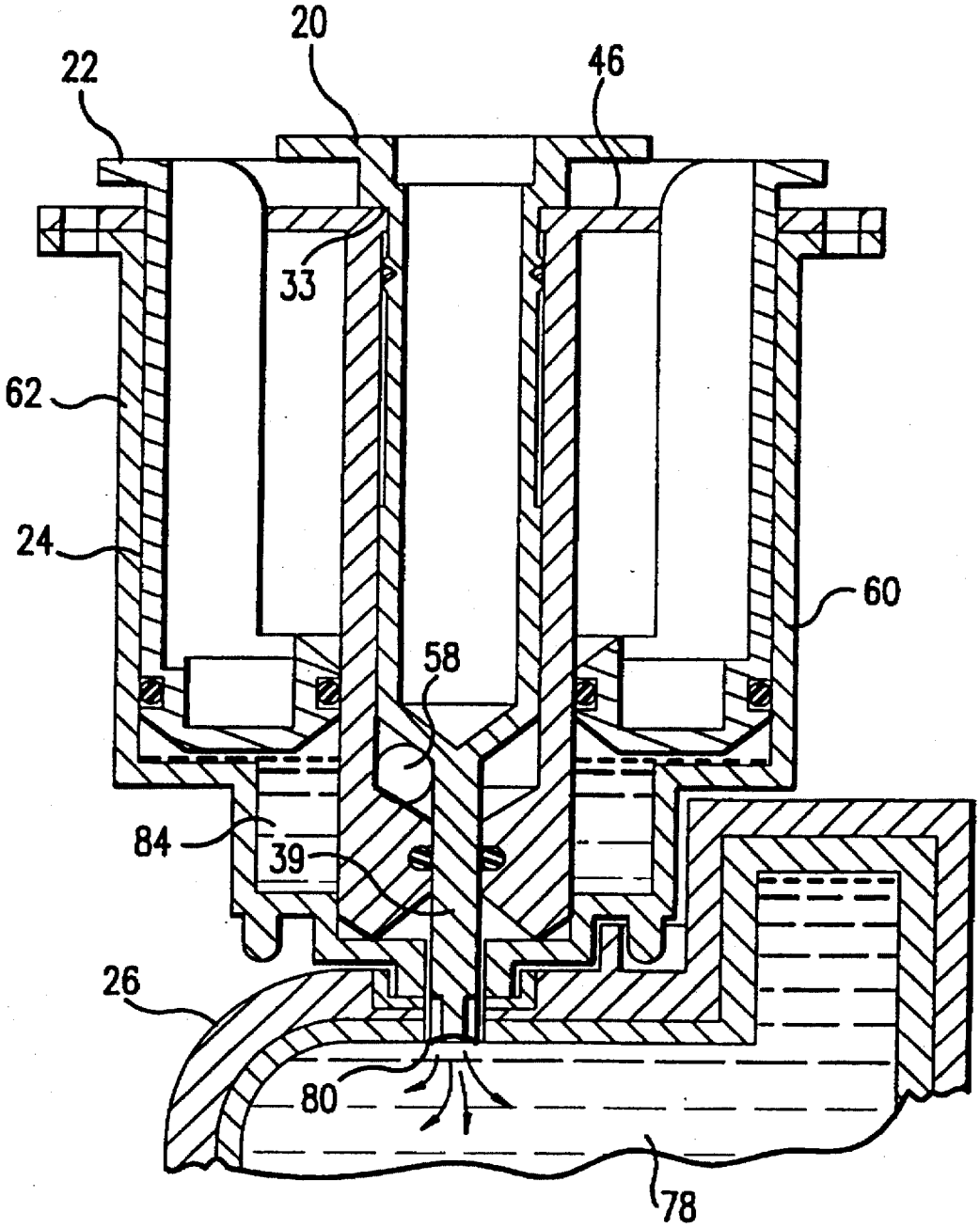

Referring to FIGS. 4 and 6, the cylinder 24 further includes a bottom portion 60 which receives the top portion 46 described above. The top and bottom portions 46, 60 are mounted together using the bolt holes 61, FIG. 4. The bottom portion includes an outer cylinder 62 which has an inner side wall 63 that is engaged and sealed by the outer O-ring 43 of the piston 22, FIG. 3. Within the bottom portion 60 of the cylinder 24 is an inner bottom wall 65 which stops the downward motion of the piston 22 as illustrated in FIG. 10. The bottom portion 60 further includes a plurality of pins 67 which engage a fitment 68 on the print cartridge 26, FIGS. 5 and 6. The pins provide stability for the apparatus and prevents its rotation during use. The bottom portion 60 further includes a cylindrical tip 70 at the lower distal end of the cylinder 24. The tip engages the print cartridge 26 as described below and forms fluid-tight sealing surface 71, FIG. 6. When the outer cylinder 62 is pressed into the print cartridge 26, the tip 70 forms an air-tight, liquid-tight, radial seal around the apparatus.

It should be noted in FIGS. 4 and 6 that when the top portion 46 and the bottom portion 60 come together, the cylinder 24 has a centering feature. Located in the bottom portion 60 is an inner well 66. The inner well receives the webs 52 and thereby aligns and supports the inner cylinder 48. This feature also promotes uniform engagement of the inner O-ring 42 against the side wall 49, FIG. 4.

Figure 5:
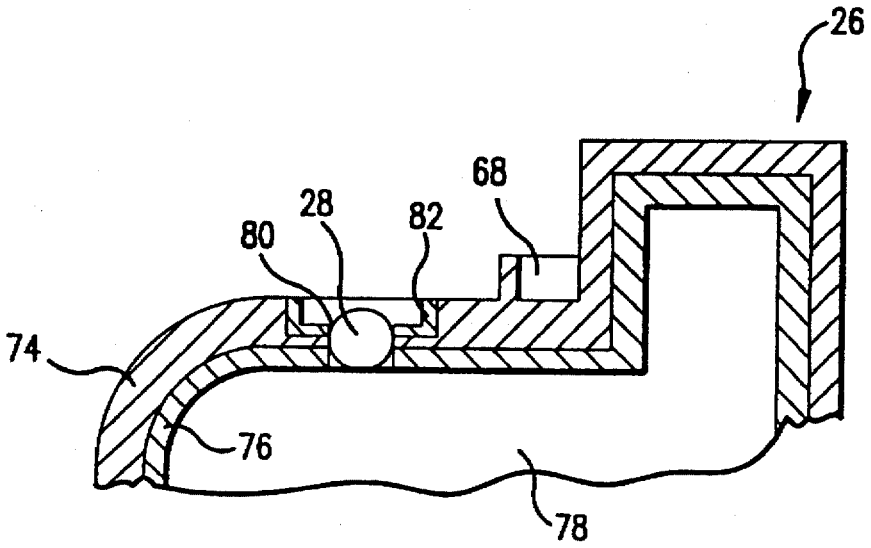
FIG. 5 is a side elevational view, in section and partially cut away, of a print cartridge having a spherical stopper.

The print cartridge 26, FIGS. 5 and 6 includes an outer rigid side wall 74 and a resiliently deformable, inner side wall 76. These side walls and two face plates (not shown) provide the boundaries of an ink reservoir 78. The ink reservoir contains a spring loaded deformable ink bag (not shown). Located in the side wall of the print cartridge is an ink fill port 80 which communicates directly with the ink reservoir 78. The port is sealed by a spherical stopper 28. The spherical stopper is retained in place by one edge of the deformable inner wall 76 and a resiliently deformable seal 82, FIG. 6. When the tip 70 of the bottom portion 60 of the cylinder 24 is inserted into the print cartridge 26, the tip engages the resiliently deformable seal 82 and forms both a liquid-tight and a gas-tight seal along the surface 71.

The print cartridge intended to be filled by the apparatus is a Hewlett-Packard Model 51640A print cartridge manufactured by the Hewlett-Packard Company, Palo Alto, Calif. although other print cartridges having spherical stoppers can also be used. This print cartridge is further described in the *Hewlett-Packard Journal,* cited above.

Figure 7:
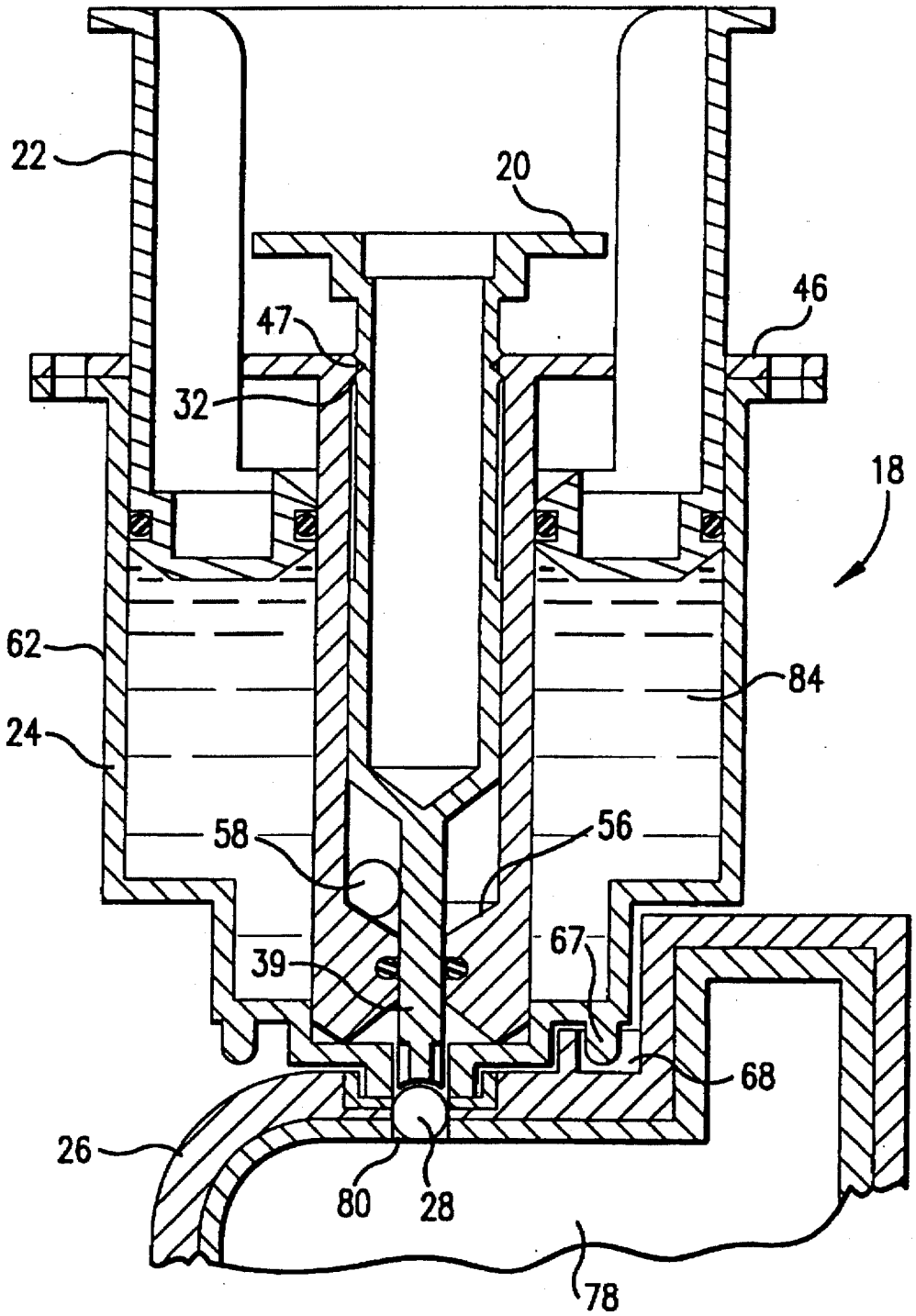
FIGS. 7–12, inclusive, are side elevational views, in section and partially cut away, illustrating the process of refilling a print cartridge having a spherical stopper with the apparatus of FIG. 1.

The fully assembled refilling apparatus 18 is illustrated in FIG. 7. The cylinder 24 is filled with refill ink 84 but not to its full capacity. The piston 22 is withdrawn to a position in the upper quadrant of the cylinder 24. Further, the stopper remover 20 is inserted into the cylinder to a point where the detents 32 engage the rim of the port 47, FIG. 4. The apparatus also contains a replacement sphere 58 which rests against the inclined surface 56, FIGS. 6 and 7 and the stem 39.

Referring to FIG. 7, in operation, the refilling apparatus 18 is brought to a vertical position over the ink inlet port 80 of a print cartridge 26. The apparatus is lowered so that the tip 70, FIG. 6 on the bottom portion 60 of the cylinder 24 is inserted into the resiliently deformable seal 82, FIG. 6. The tip and the deformable seal 82 form a gas-tight and liquid-tight seal along the sealing surface 71, FIG. 6. One of the pins 67 also engages the fitment 68 for stability.

Figure 8:
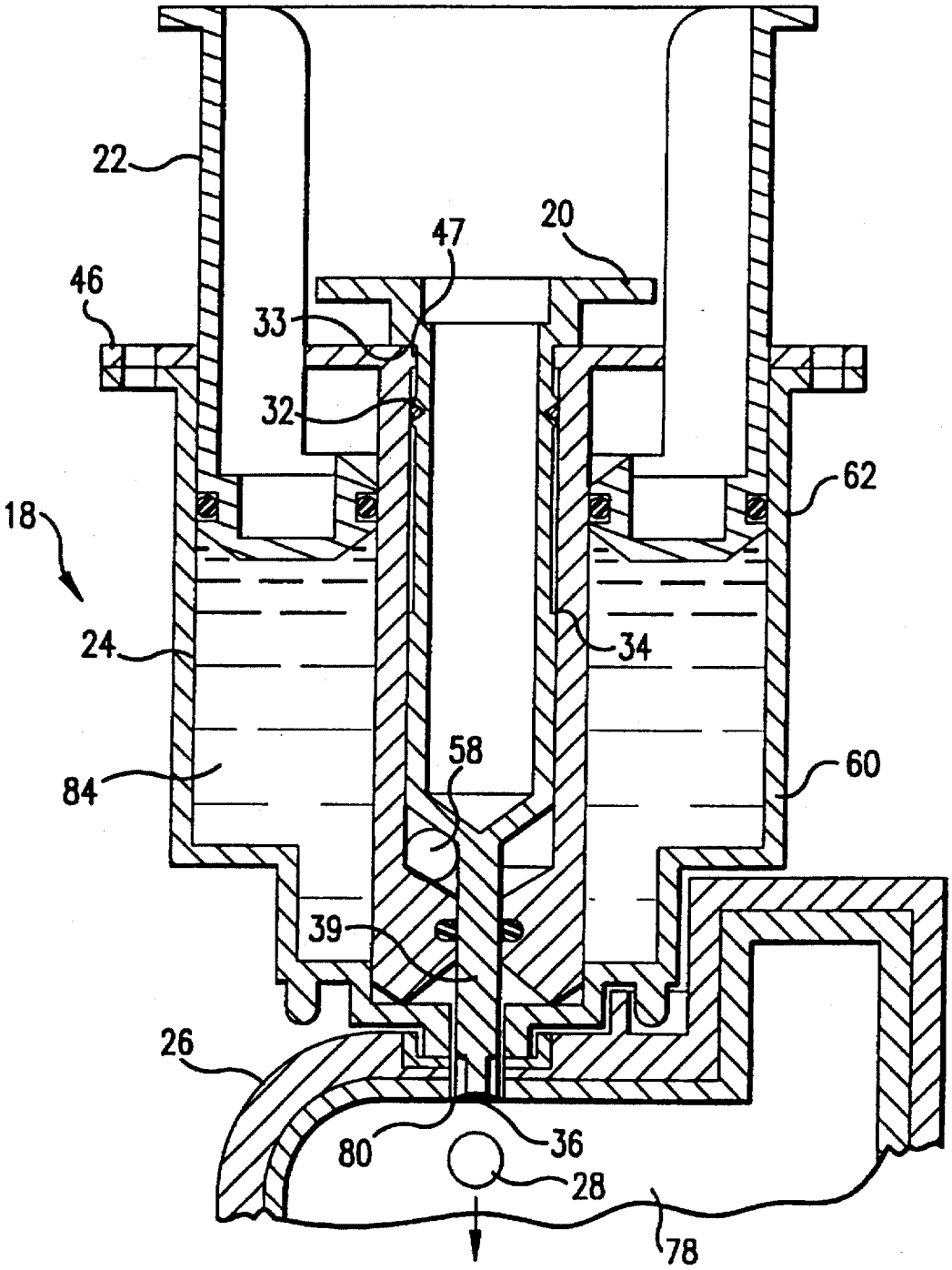

Referring to FIG. 8, once the tip 70 of the cylinder 24 has made a fluid-fight seal, the stopper remover 20 is pressed downward by the operator until the hard stop 33, FIG. 2 comes to rest against the upper rim of the port 47 of the cylinder 24. This motion causes the concave tip 36 of the stem 39 to engage the spherical stopper 28 and to force the stopper downward and out of the port 80 into the ink reservoir 78 as illustrated in FIG. 8. The piston 22 is not moved with respect to the cylinder 24 in the process illustrated in FIG. 8.

Figure 9:
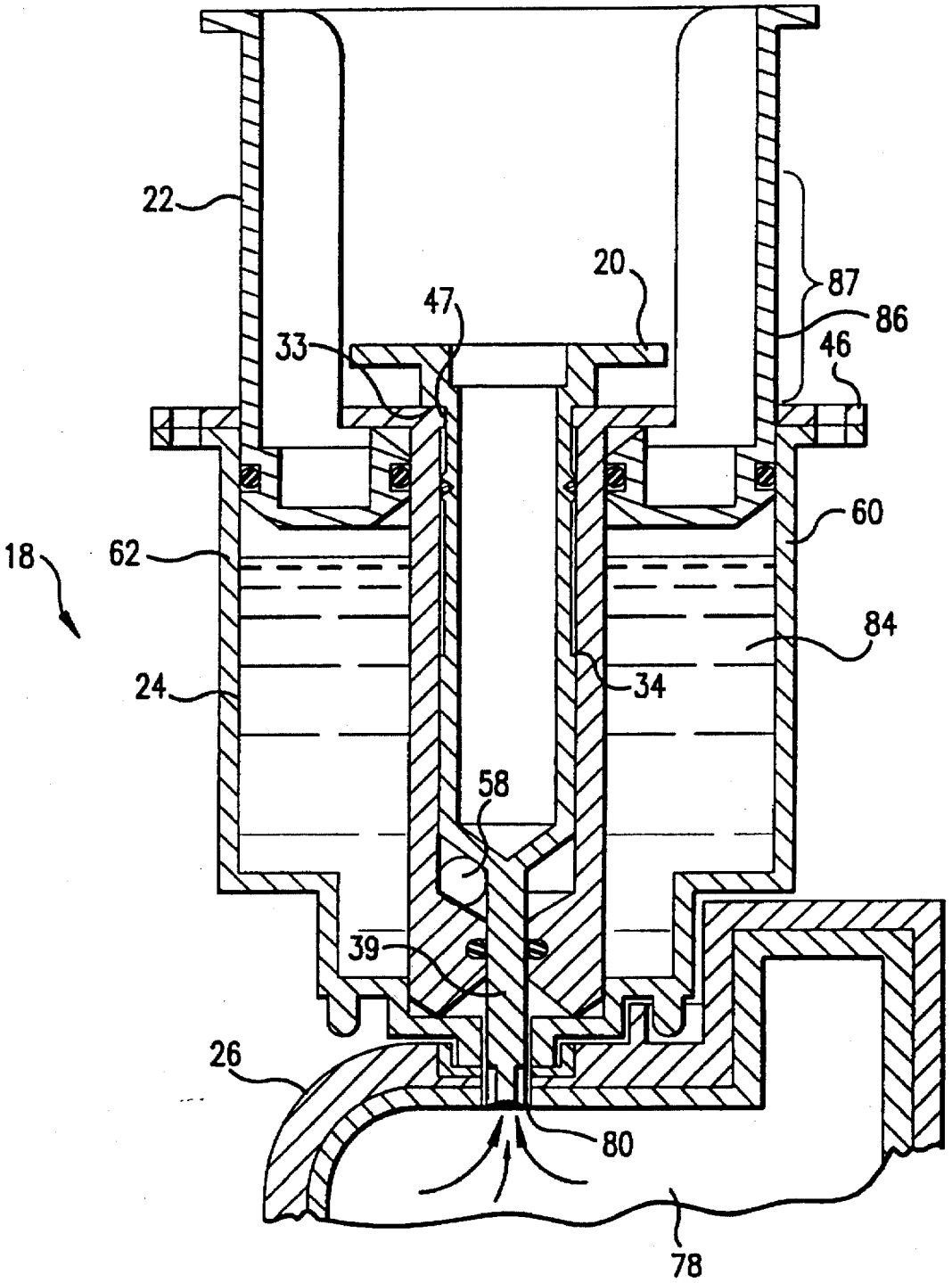

In FIG. 9 the step of emptying any residual ink from the ink reservoir 78 is illustrated. The piston 22 is withdrawn in an upward direction with respect to the cylinder 24. This withdrawal process continues until the operator encounters a substantial resistance to further motion, indicating that the residual ink in the ink reservoir has been removed. In this step the stopper remover 20 is not moved with respect to cylinder 24, and the hard stop 33 remains against the upper rim of the port 47.

The step illustrated in FIG. 9 removes any undissolved gasses which were trapped in the print cartridge 26 before refilling and also any dissolved gasses which may have been introduced during the sealing process between the tip 70 of the cylinder 24 and the print cartridge 26. The purging of undissolved gasses as described above during refilling is important so that any bubbles that could block the flow of ink through the narrow passages of the print head are removed.

Referring to FIG. 10, the refill ink 84 is transferred from the cylinder 24 into the ink reservoir 78 by moving the piston 22 in a downward direction so that a predetermined volume of ink is inserted into the reservoir 78. In the Hewlett-Packard print cartridge model number 51640A, a volume of 50 cc's of refill ink is inserted into the print cartridge. There are numerical indices 86 on the outer side wall of the piston 22 as illustrated in FIG. 1 which indicate increments of volume. The operator measures the level of ink when the apparatus is in the position illustrated in FIG. 9, that is, when the piston 22 has been withdrawn until a substantial resistance has been sensed, indicating that the ink reservoir 78 is empty. The operator then calculates the final level of ink corresponding to the predetermined volume of ink to be transferred. The level interval is indicated by reference numeral 87, FIG. 9. When the level equivalent to a volume of 50 cc's is reached, the operator ceases the downward motion of the piston 22. At this point the print cartridge has been refilled to its normal operating level and the internal operating pressure in the reservoir 78 has been restored.

Figure 11:
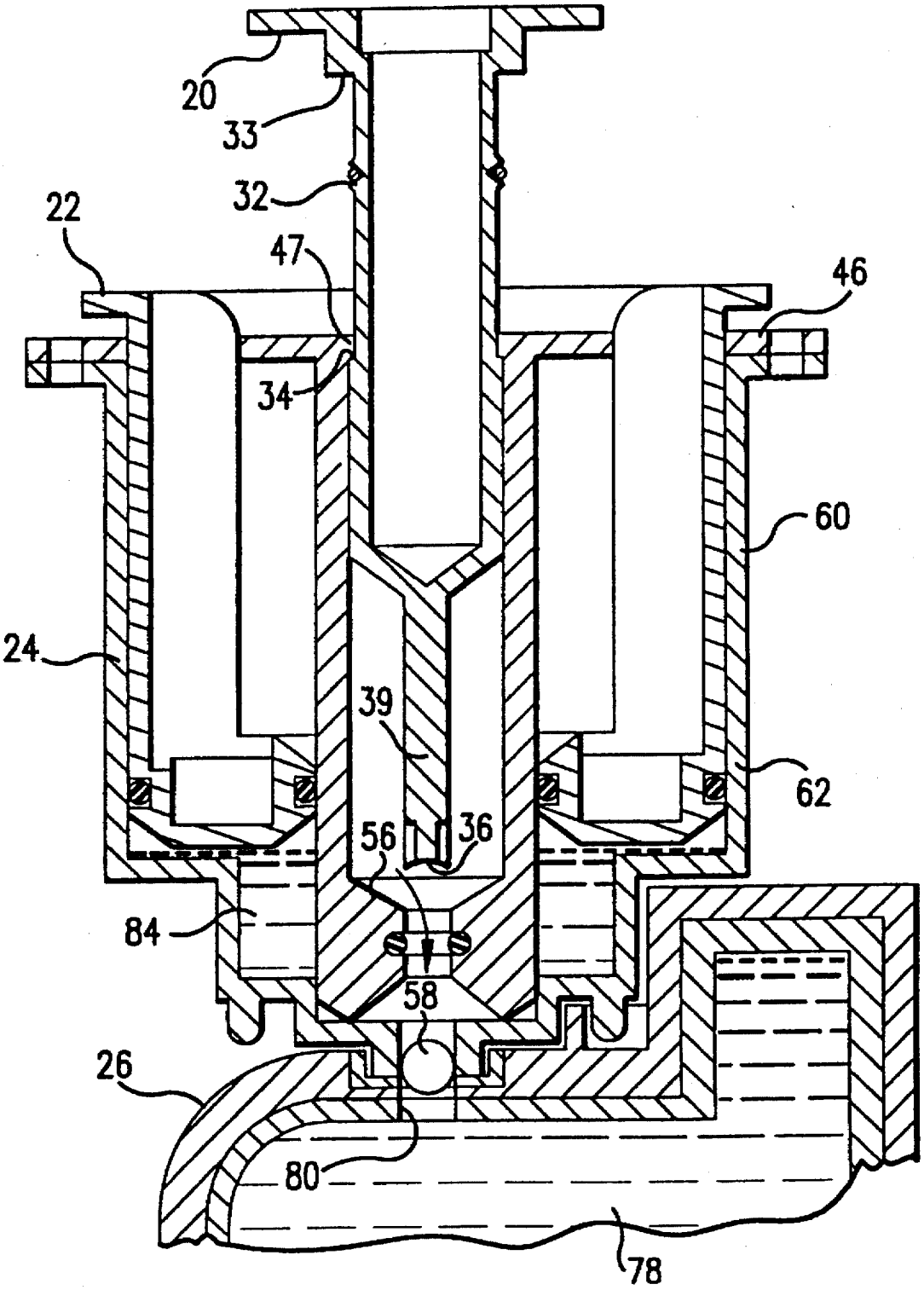

Next, the stopper remover 20, FIG. 11 is withdrawn with respect to the cylinder 24. The stopper remover travels upward until the hard stop 34 engages the lower rim of the port 47. At this point the stem 39 of the stopper remover has cleared the spherical stopper 58 as illustrated in FIG. 8. Once the stem has cleared the stopper 58, the stopper rolls down the inclined surface 56 past the O-ring 54 and comes to rest in the tip 70 of the cylinder 24.

Figure 12:
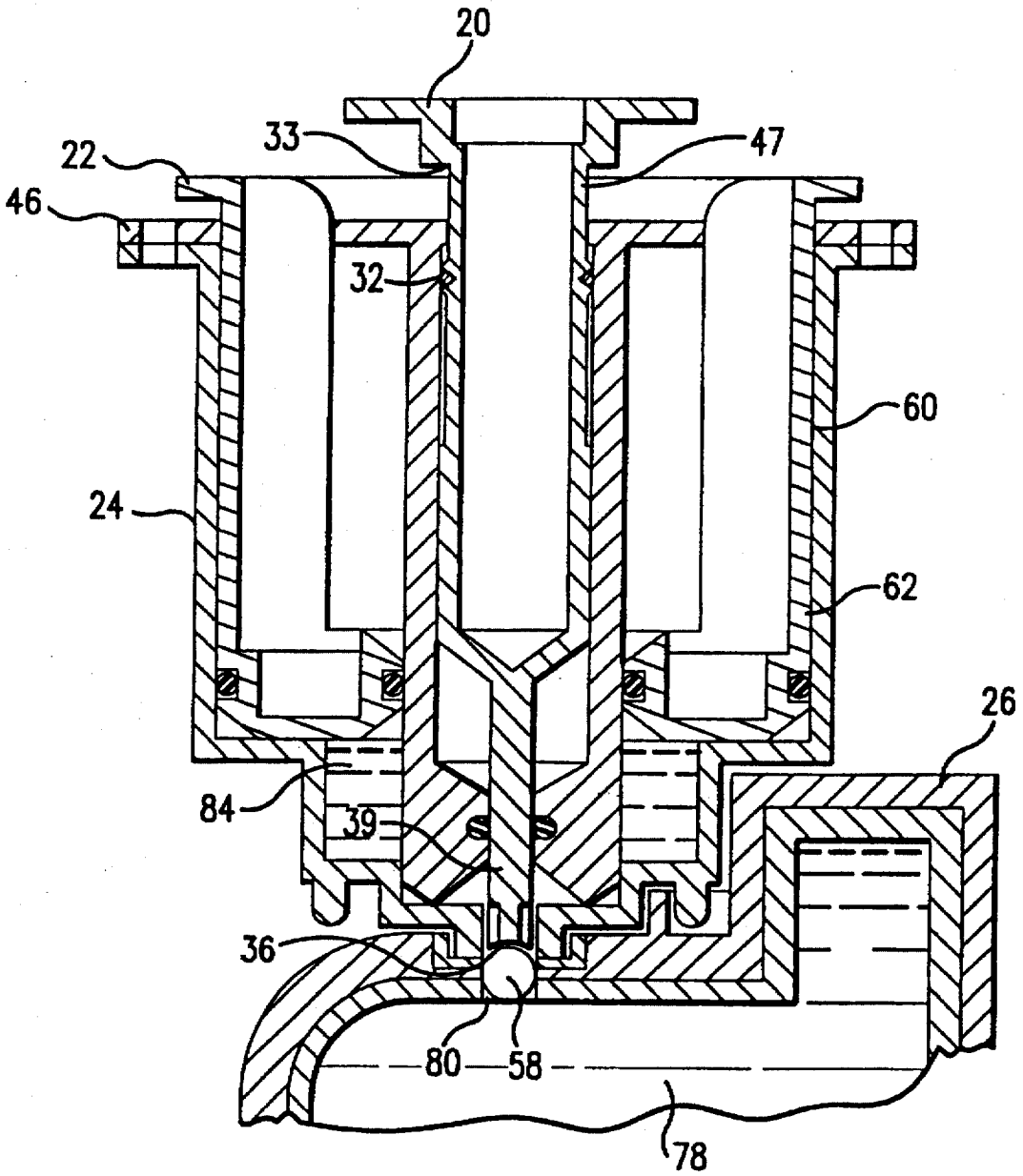

In FIG. 12 the replacement spherical stopper 58 is seated in the port 80 of the print cartridge 26. The stopper remover 22 is pushed downward and the concave tip 36 on the end of the stem engages the replacement stopper 58. Downward motion continues until the detents 32 on the stopper remover 20 engage the rim of the port 47 in the top portion 46 of the cylinder 24. At this point, the replacement spherical stopper 58 is seated in the print cartridge and the ink inlet port 80 is sealed. Thereafter, the refilling apparatus 18 is pulled upward and away from the print cartridge 26, the two units are disengaged, and the sealing surface 71, FIG. 6 is separated. The refilling operation is thus completed.

Figure 13:
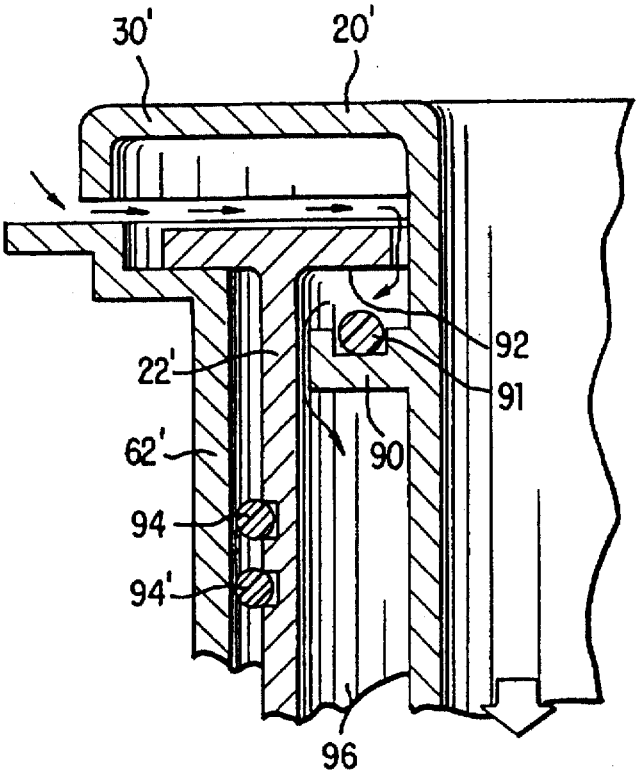
FIGS. 13 and 14 are side elevational views, in section and partially cut away, of an alternative embodiment for refilling, venting and purging a print cartridge having a spherical stopper.
Figure 14:
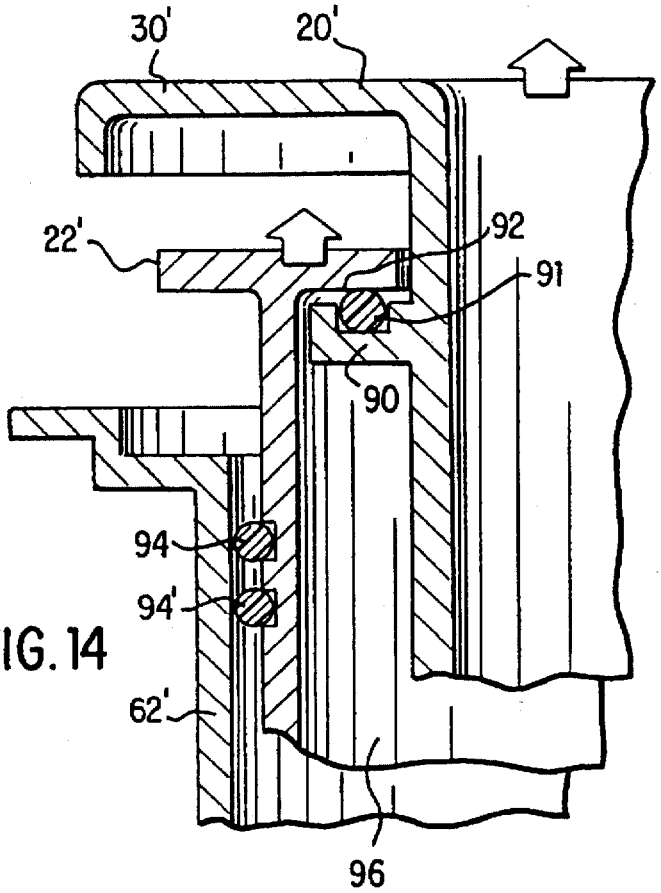

Referring to FIGS. 13 and 14, reference numeral 88 generally indicates an alternative embodiment for sealing and venting a refilling apparatus. The stopper remover 20' is an elongate, hollow member constructed in the same manner as described above. In addition, the stopper remover has an annular ring 90 in its outer side wall and this annular ring contains an upwardly directed O-ring grove and an O-ring 91. The 0-ring 91 can engage the lower surface 92 of the piston 22' as illustrated in FIG. 14. The piston 22' is likewise constructed in the same manner as described above. The piston 22' further contains two O-rings 94, 94' located in O-ring groves in its outer side wall. These O-rings seal against the sidewall of the outer cylinder 62'.

In operation, the flange 30' of the stopper remover 20' is moved in a downward direction as illustrated in FIG. 13, and the O-ring 91 and the surface 92 separate. This motion vents the chamber 96 to the atmosphere. The stopper remover 20' is moved downward until it dislocates the spherical stopper 28 as illustrated in FIG. 8. Because the chamber 96 is vented to the atmosphere, the refill ink (not shown) in the cylinder flows downward into the print cartridge 26 by the force of gravity and fills it.

After filling the print cartridge (not shown), the stopper remover 20' is moved in an upward direction. This movement causes the O-ring 91 to engage the surface 92 and to likewise move the piston 22' upward. This motion primes the print cartridge (not shown) and the vacuum created thereby removes any excess ink from the print cartridge. This upward motion also causes the stem 39 of the stopper remover 20 to release a replacement stopper 58 as illustrated in FIG. 11. Thereafter, the stopper remover 20' is moved in a downward direction as illustrated in FIG. 13 and a vent to the atmosphere is created in the chamber 96. This is downward motion also seats the replacement spherical stopper 58 as illustrated in FIG. 12.

It should be noted that in this process the print cartridge is first overfilled with replacement ink by the motion illustrated in FIG. 13. The replacement ink flows into the print cartridge by the force of gravity and is not measured as illustrated in FIG. 9. Thereafter, as illustrated in FIG. 14, the stopper remover 20' and the piston 22' are withdrawn and the seal between the surface 92 and the O-ring 91 closes the vent. This motion in FIG. 14 removes any excess ink from the print cartridge and returns the print cartridge to its normal operating pressure.

Although specific embodiments of the invention have been described and illustrated, the invention is not to be limited to the specific forms or arrangement of parts so described and illustrated. The invention is limited only by the claims.

I claim:

1. Apparatus for refilling a print cartridge with ink, said print cartridge having a spherical stopper, comprising:

a) a cylinder and a piston received therein, said cylinder having an ink outlet which transfers ink from said cylinder to the print cartridge as said piston is pushed further into said cylinder;

b) a sealing surface on said ink outlet for establishing an ink-tight seal between the ink outlet and the print cartridge; and c) a stopper remover for engaging and dislocating the spherical stopper for opening the print cartridge for receiving ink while said ink-tight seal is established, said stopper remover being operatively connected to the cylinder, wherein the apparatus is portable and hand-held during use.

2. The apparatus of claim 1 further including a replacement stopper within the apparatus, said replacement stopper being sealable in the print cartridge with the stopper remover.

3. The apparatus of claim 1 including means, connected to the sealing surface, for emptying the print cartridge of substantially all ink prior to refilling the print cartridge with ink.

4. The apparatus of claim 1 wherein the cylinder contains a volume of ink sufficient to refill the print cartridge only one time.

5. Apparatus for refilling a print cartridge with ink, said print cartridge having a spherical stopper, comprising:

a) a cylinder and a piston received therein, said cylinder having an ink outlet which transfers ink from said cylinder to the print cartridge as said piston is pushed further into said cylinder, wherein the cylinder and piston have a generally toroidal shape;

b) a sealing surface on said ink outlet for establishing an ink-tight seal between the ink outlet and the print cartridge; and c) a stopper remover for engaging and dislocating the spherical stopper for opening the print cartridge for receiving ink, said stopper remover being operatively connected to the cylinder, wherein the stopper remover is an elongate, longitudinal member centrally located within and co-axial with the toroidal cylinder.

6. The apparatus of claim 5 wherein the piston is mounted for relative motion with respect to the cylinder and the stopper remover is mounted for relative motion with respect to both the cylinder and the piston.

7. The apparatus of claim 5 wherein the cylinder contains a volume of ink sufficient to refill the print cartridge only one time.

8. Apparatus for refilling a print cartridge with ink, said print cartridge having a spherical stopper, comprising:

a) a stopper remover for engaging and dislocating the spherical stopper for opening the print cartridge for receiving ink, said stopper remover having a generally elongate shape and located along a longitudinal axis;

b) a cylinder for holding ink for refilling, said cylinder having a generally annular shape orthogonal to the longitudinal axis of the stopper remover;

c) a piston for transferring said ink to said print cartridge, said piston being received in the cylinder and having a generally annular shape orthogonal to the longitudinal axis of the stopper remover; and d) an ink outlet in fluid communication with the cylinder, said outlet having a sealing surface for establishing a liquid-tight seal with respect to a print cartridge, said outlet also containing a portion of the stopper remover for opening the print cartridge, while said liquid-tight seal is established, for receiving said ink through the outlet.

9. Apparatus for refilling a print cartridge with ink, said print cartridge having a spherical stopper, comprising:

a) a stopper remover for engaging and dislocating the spherical stopper for opening the print cartridge for receiving ink, said stopper remover having a generally elongate shape and located along a longitudinal axis;

b) a cylinder for holding ink for refilling, said cylinder having a generally annular shape orthogonal to the longitudinal axis of the stopper remover;

c) a piston for transferring said ink to said print cartridge, said piston being received in the cylinder and having a generally annular shape orthogonal to the longitudinal axis of the stopper remover;

d) an ink outlet in fluid communication with the cylinder, said outlet having a sealing surface for establishing a liquid-tight seal with respect to a print cartridge, said outlet also containing a portion of the stopper remover for opening the print cartridge for receiving said ink through the outlet; and e) a plurality of webs on a distal end of the stopper remover for providing ink flow passages to the ink outlet.

10. Apparatus for refilling a print cartridge with ink, said print cartridge having a spherical stopper, comprising:

a) a stopper remover for engaging and dislocating the spherical stopper for opening the print cartridge for receiving ink, said stopper remover having a generally elongate shape and located along a longitudinal axis;

b) a cylinder for holding ink for refilling, said cylinder having a generally annular shape orthogonal to the longitudinal axis of the stopper remover;

c) a piston for transferring said ink to said print cartridge, said piston being received in the cylinder and having a generally annular shape orthogonal to the longitudinal axis of the stopper remover;

d) an ink outlet in fluid communication with the cylinder, said outlet having a sealing surface for establishing a liquid-tight seal with respect to a print cartridge, said outlet also containing a portion of the stopper remover for opening the print cartridge for receiving said ink through the outlet; and e) a plurality of webs forming an inner wall of the cylinder, said webs providing ink flow passages to the ink outlet.

11. Method for refilling a print cartridge with ink, said print cartridge having an ink reservoir and a spherical stopper, comprising the steps of:

a) removing the print cartridge from an ink-jet printer;

b) establishing fluid communication between the print cartridge ink reservoir and a reservoir of refilling ink, wherein the reservoir of refilling ink contains ink for only one refill of the print cartridge;

c) manually sealing the reservoir of refilling ink with respect to the print cartridge with an ink-tight seal;

d) manually emptying residual ink from the print cartridge ink reservoir;

e) transferring ink from the reservoir of refilling ink to the print cartridge reservoir;

f) manually unsealing the reservoir of refilling ink from the print cartridge; and g) disposing of the reservoir of refilling ink, after manually unsealing the reservoir of refilling ink from the print cartridge.

12. The method of claim 11 further including the step of withdrawing any undissolved gasses from the print cartridge concurrently with the step of emptying the residual ink.

13. The method of claim 11 further including the steps of a) measuring a predetermined volume of ink and b) transferring the predetermined volume of ink to the print cartridge ink reservoir.

14. The method of claim 11 further including the steps of a) dislocating the original spherical stopper with respect to the print cartridge and b) seating a new spherical stopper in the print cartridge after performing the step of transferring ink from the reservoir of refilling ink.

15. The method of claim 11 wherein the step of transferring ink from the reservoir of refilling ink includes the steps of a) over filling the print cartridge ink reservoir with refill ink and b) thereafter purging the excess ink from the print cartridge ink reservoir.

16. Method for refilling a print cartridge with ink, said print cartridge having an ink reservoir and a spherical stopper, comprising the steps of:

a) establishing fluid communication between the print cartridge ink reservoir and a reservoir of refilling ink;

b) sealing the reservoir of refilling ink with respect to the print cartridge with an ink-tight seal;

c) substantially emptying residual ink from the print cartridge ink reservoir;

d) measuring the volume of residual ink emptied from the print cartridge;

e) measuring a predetermined volume of ink such that said volume of residual ink emptied and an additional amount of ink added to said residual ink emptied equals said predetermined volume;

f) transferring the predetermined volume of ink from the reservoir of refilling ink to the print cartridge reservoir; and g) unsealing the reservoir of refilling ink from the print cartridge.

* * * * *